US007937962B2

(12) United States Patent
Dudley et al.

(10) Patent No.: US 7,937,962 B2
(45) Date of Patent: May 10, 2011

(54) METHOD FOR CONTROLLING TEMPERATURE IN MULTIPLE COMPARTMENTS FOR REFRIGERATED TRANSPORT

(75) Inventors: Eliot W. Dudley, Cato, NY (US); Gilbert B. Hofsdal, Canastota, NY (US)

(73) Assignee: Carrier Corporation, Farmington, CT (US)

( * ) Notice: Subject to any disclaimer, the term of this patent is extended or adjusted under 35 U.S.C. 154(b) by 414 days.

(21) Appl. No.: 12/159,131

(22) PCT Filed: Jan. 20, 2006

(86) PCT No.: PCT/US2006/002444

§ 371 (c)(1), (2), (4) Date: Jun. 25, 2008

(87) PCT Pub. No.: WO2007/084138

PCT Pub. Date: Jul. 26, 2007

(65) Prior Publication Data

US 2008/0289354 A1 Nov. 27, 2008

(51) Int. Cl.
*F25B 5/00* (2006.01)
*F24F 3/00* (2006.01)

(52) U.S. Cl. ..... 62/200; 62/513; 165/208

(58) Field of Classification Search ..... 62/199, 62/200, 513; 236/1 B; 165/208
See application file for complete search history.

(56) References Cited

U.S. PATENT DOCUMENTS 4,439,998 A 4/1984 Horvay et al.
5,163,301 A * 11/1992 Cahill-O'Brien et al. ..... 62/217
6,460,358 B1 * 10/2002 Hebert ..... 62/225
6,804,972 B2 10/2004 El-Habhab

OTHER PUBLICATIONS

International Preliminary Report on Patentability mailed Jul. 31, 2008 (5 pgs.).
International Search Report and Written Opinion mailed Aug. 3, 2006 (9 pgs.).

* cited by examiner

*Primary Examiner* — Marc E Norman
(74) *Attorney, Agent, or Firm* — Marjama Muldoon Blasiak & Sullivan LLP

(57) ABSTRACT

A refrigerated transport system includes a prioritizing algorithm to limit the maximum amount of refrigerant flow available to at least one limited cooling compartment by holding a delta T (difference between the supply air temperature and return air temperature) instead of a setpoint temperature in the at least one limited cooling compartment when the available cooling capacity is insufficient to hold a substantially constant temperature in all compartments. A method for creating multiple refrigerated compartment spaces having precision temperature control includes the steps of: prioritizing the compartments by identifying at least one priority compartment to be held at a setpoint temperature; and limiting refrigerant flow to all but the priority compartment when there is insufficient cooling capacity to maintain all compartments at their respective setpoint temperatures.

21 Claims, 9 Drawing Sheets

METHOD FOR CONTROLLING TEMPERATURE IN MULTIPLE COMPARTMENTS FOR REFRIGERATED TRANSPORT

FIELD OF THE INVENTION

This invention relates generally to refrigerated transport compartments and more specifically to a method and system for improving temperature control in a multiple compartment refrigerated transport.

BACKGROUND OF THE INVENTION

Transport refrigeration systems are used for transporting perishable goods, such as refrigerated and frozen food products. Transport refrigeration systems include refrigerated containers, trucks, and railroad cars. Some products require more accurate temperature control of the refrigerated compartment than others to preserve product freshness. For example, some frozen foods may need only to be kept below a certain freezing temperature, with less sensitivity to a specific set point temperature. Other goods, such as some perishable produce such as fruits or vegetables might require a tighter temperature regulation to preserve optimal product freshness.

Transport refrigeration systems can be divided into two or more compartments by inserting an internal wall. The individual spaces can be kept at different temperatures. For example, one compartment can be a freezer compartment and the other compartment can be refrigerated. Typically such dual compartment shipping container systems use one refrigeration compressor and two evaporators, one for each compartment. While the primary compartment might have a proportional refrigerant pressure control, the existing method of secondary compartment temperature control is to cycle on and off the liquid refrigerant line to the secondary compartment evaporator. This method of cycling the secondary evaporator liquid refrigerant line on and off to control the temperature in the secondary compartment cannot achieve the temperature regulation tolerance that is needed in many applications. Therefore what is needed is a method and apparatus to improve the temperature regulation in a secondary refrigerated compartment.

Another problem involving multiple compartment transport refrigeration systems is how to apportion the available cooling capacity at startup and/or under high load conditions, such as when the ambient temperature is very high. What is needed is a control algorithm to apportion available cooling capacity by a priority system between a primary compartment and a secondary compartment.

Yet another problem is to limit the electrical power consumption of a multiple compartment transport refrigeration system at startup and/or under high load conditions, such as when the ambient temperature is very high. For example, ocean going container ships may have power limits and/or circuit breakers that limit the ampacity of the electrical power supply line to each refrigerated transport container. A typical current limit is 15 to 23 amperes, with circuit interruption protection typically set to 30 amperes (maximum). Therefore, what is also needed is a method of control for a multi-compartment transport refrigeration system that can limit the electrical load to a preset value while apportioning the resulting cooling capacity between the compartments.

SUMMARY OF THE INVENTION

A refrigerated transport system includes a compressor to supply high pressure refrigerant vapor to a condenser. The compressor is coupled to the condenser, the condenser to condense the high pressure vapor to a high pressure liquid. The refrigerated transport system also includes a primary compartment evaporator to accept heat from the air in a primary compartment and to transfer the heat to a refrigerant circulated within the primary compartment evaporator to refrigerate the primary compartment, the primary compartment evaporator coupled to a primary compartment expansion device for receiving low pressure liquid from the primary compartment expansion device. The primary compartment expansion device is coupled to the condenser, and a primary refrigerant flow through the primary compartment evaporator is controlled by a controller using a primary compartment temperature feedback from a temperature sensor in the primary compartment to control the temperature in the primary compartment. The refrigerated transport system also includes at least one secondary compartment evaporator to accept heat from the air in a secondary compartment and to transfer the heat to a refrigerant circulated within the secondary compartment evaporator to refrigerate the secondary compartment, the secondary compartment evaporator is coupled to a secondary compartment expansion device for receiving low pressure liquid from the secondary compartment expansion device. The secondary compartment expansion device is coupled to the condenser. A secondary refrigerant flow through the secondary compartment evaporator is controlled by a controller using a secondary compartment temperature feedback from a temperature sensor in the secondary compartment to control the temperature in the secondary compartment and wherein a prioritizing algorithm limits the maximum amount of refrigerant flow available to at least one limited cooling compartment by holding a delta T (difference between the supply air temperature and return air temperature) instead of a setpoint temperature in the at least one limited cooling compartment when the available cooling capacity is insufficient to hold a substantially constant temperature in all compartments.

A method for creating multiple refrigerated compartment spaces having precision temperature control includes the steps of: providing a common compressor to supply high pressure refrigerant vapor; providing a common condenser to condense the high pressure refrigerant vapor to a high pressure liquid; providing a primary compartment evaporator to accept heat from the air in a primary compartment and to transfer the heat to a refrigerant; providing a secondary compartment evaporator to accept heat from the air in a secondary compartment and to transfer the heat to a refrigerant; compressing the refrigerant; condensing the refrigerant; supplying the refrigerant via expansion devices to the primary compartment evaporator and the secondary compartment evaporator; regulating the refrigerant flow to the primary compartment evaporator and the secondary compartment evaporator to control the temperature in both compartments to respective setpoint temperatures using temperature feedback signals from each respective compartment; prioritizing the compartments by identifying at least one priority compartment to be held at a setpoint temperature; and limiting refrigerant flow to all but the priority compartment when there is insufficient cooling capacity to maintain all compartments at their respective setpoint temperatures.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1:
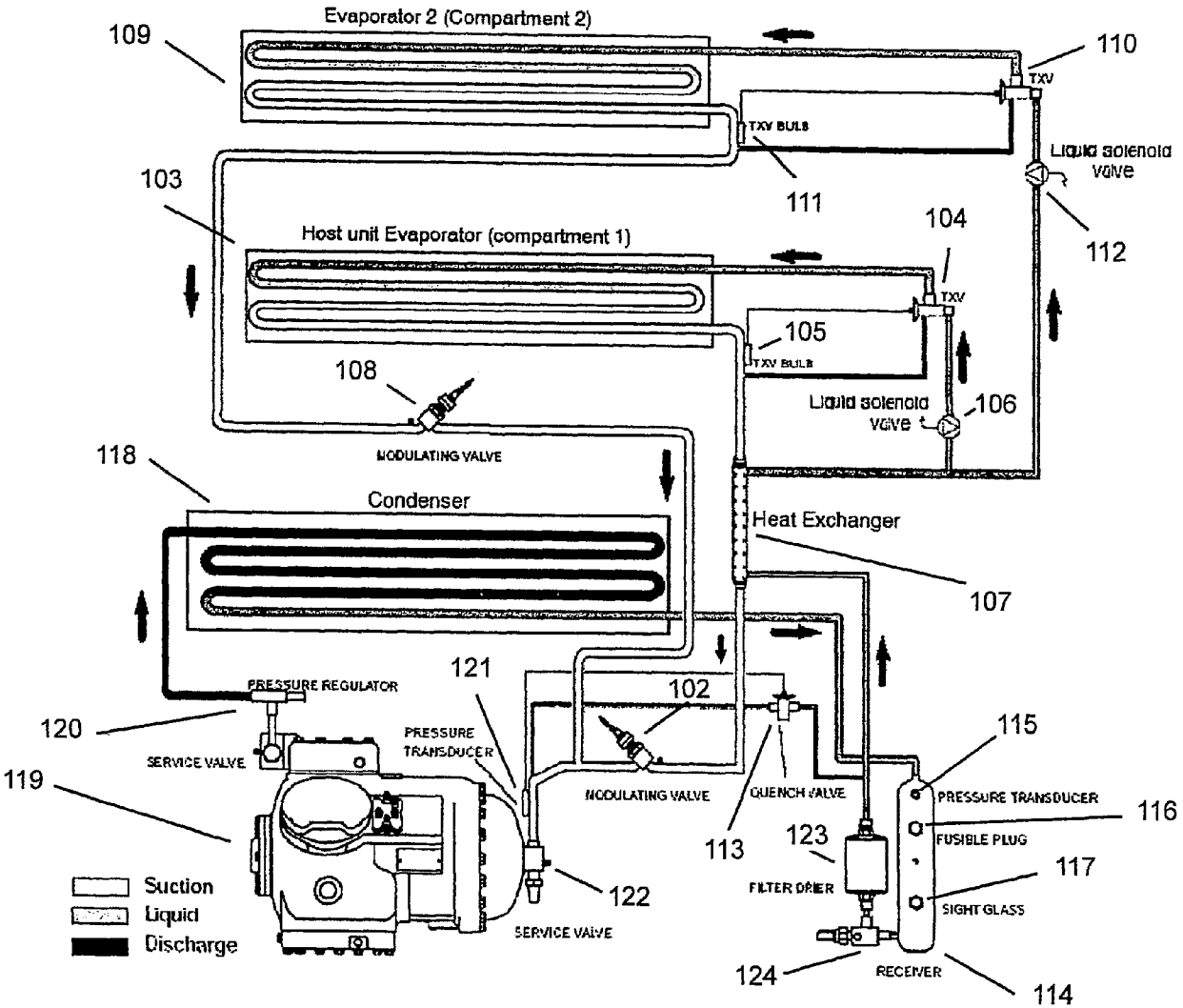
FIG. 1 Shows a diagram of the inventive dual compartment refrigerated transport apparatus.

The solution to the problem of achieving precision temperature control in a secondary transportation compartment as shown in FIG. 1 is to regulate the secondary compartment evaporator suction pressure and thereby refrigerant flow. One advantageous way to regulate second compartment evaporator suction pressure is by the use of an electronic suction modulation valve (ESMV) such as shown in FIG. 1 by ESMV 108 to control the suction pressure from a secondary compartment evaporator 109. In this manner the temperature in the secondary compartment can be controlled as required, for instance to within plus or minus one half kelvin of the setpoint temperature. Transport refrigeration system compartments according to the invention can be constructed in any type of suitable refrigerated transport, including aircraft shipping containers, ocean going shipping containers, tractor trailer trucks, and railroad cars. Usually such containers are refrigerated containers, however, non refrigerated containers can also be fitted with components according to the invention to create multiple refrigerated spaces within.

The operation of the exemplary dual compartment refrigerated container according to the invention as shown in FIG. 1 is now explained. The typical components to carry out the refrigeration cycle include compressor 119, condenser 118, receiver 114, a main compartment host unit evaporator 103, and thermostatic expansion valve (TXV) 104 with corresponding TXV bulb 105. In normal operation, low pressure refrigerant vapor is compressed to create a high pressure refrigerant vapor discharge by compressor 119. Condenser 118 converts the high pressure refrigerant vapor discharge to a high pressure refrigerant liquid. Pressure regulator 120 is part of the compressor 119 mechanical system and sets a discharge pressure based on the type of refrigerant to achieve a minimum desired discharge pressure. Receiver 114 can comprise a condenser pressure transducer (CPT) 115, fusible plug 116, sight glass 117, and attached King valve 124. Receiver 114 also serves a refrigerant storage container. Fusible plug 116 serves as a system over temperature or over pressure safety device. Fusible plug 116 can comprise a lead plug that melts at very high temperature or pressure. Pressure transducer 115 can be used to cycle one or more condenser fan(s) (condenser fans not shown) on an off in order to lower to the condenser pressure. When king valve 117 is closed all of the refrigerant can be pumped from the compressor and condenser into receiver 114. This procedure allows for a low side repair or replacement of compressor 119 without having to remove the refrigerant from the system. Filter dryer 123 serves to remove water from the liquid. Quench valve 113 can be used to cool compressor 119 in conjunction with sense bulb and pressure feedback 121 to determine if refrigerant needs to be added to the compressor line to help it to cool. Heat exchanger 107 can be used to improve system capacity by cooling the liquid line to reduce the temperature of the liquid entering TXV 104. System efficiency can be improved as the difference in temperature across TXV 104 is made smaller through use of one or more heat exchangers. For example, system capacity can be improved by adding another heat exchanger, such as between evaporator 109 and ESMV 108. Liquid refrigerant can be supplied under pressure to TXV 104 via a liquid shut off valve 106, useful for securing refrigeration to a compartment, such as turning off a compartment or for servicing isolated parts of the refrigeration system. TXV 104 causes the liquid refrigerant to expand to a low pressure liquid. TXV 104 can be electronic or mechanical and regulates the amount of refrigerant going into the evaporator based on a TXV bulb 105 pressure that senses the temperature measurement on the output of the evaporator and a pressure reading. TXV 104 settings are typically based on capacity and the type of refrigerant and are typically provided by manufacturers for individual TXV products. Host compartment evaporator 103 transfers heat energy from the main compartment to the refrigerant circulating in evaporator 103 converting it from a low pressure liquid to a low pressure vapor. An electronic suction valve 102 regulates the temperature in a first compartment (compartment 1) using electronic controls as described below.

To accommodate precise temperature control in a secondary compartment (compartment 2), the high pressure liquid refrigerant that supplies TXV 104 can also supply refrigerant to a second TXV 110. Note that solenoid valve 112 is provided to turn off (secure) the refrigeration in compartment 2, but that solenoid valve 112 is not used for temperature control of compartment 2 as is done by the prior art. TXV 110 causes the liquid refrigerant to expand to a low pressure liquid. Secondary compartment evaporator 109 transfers heat energy from the secondary compartment to the refrigerant circulating in evaporator 109 converting it from a low pressure liquid to a low pressure vapor. An electronic suction modulating valve ESMV 108 regulates the temperature in a secondary compartment (compartment 2) using electronic controls as described below.

Figure 2:
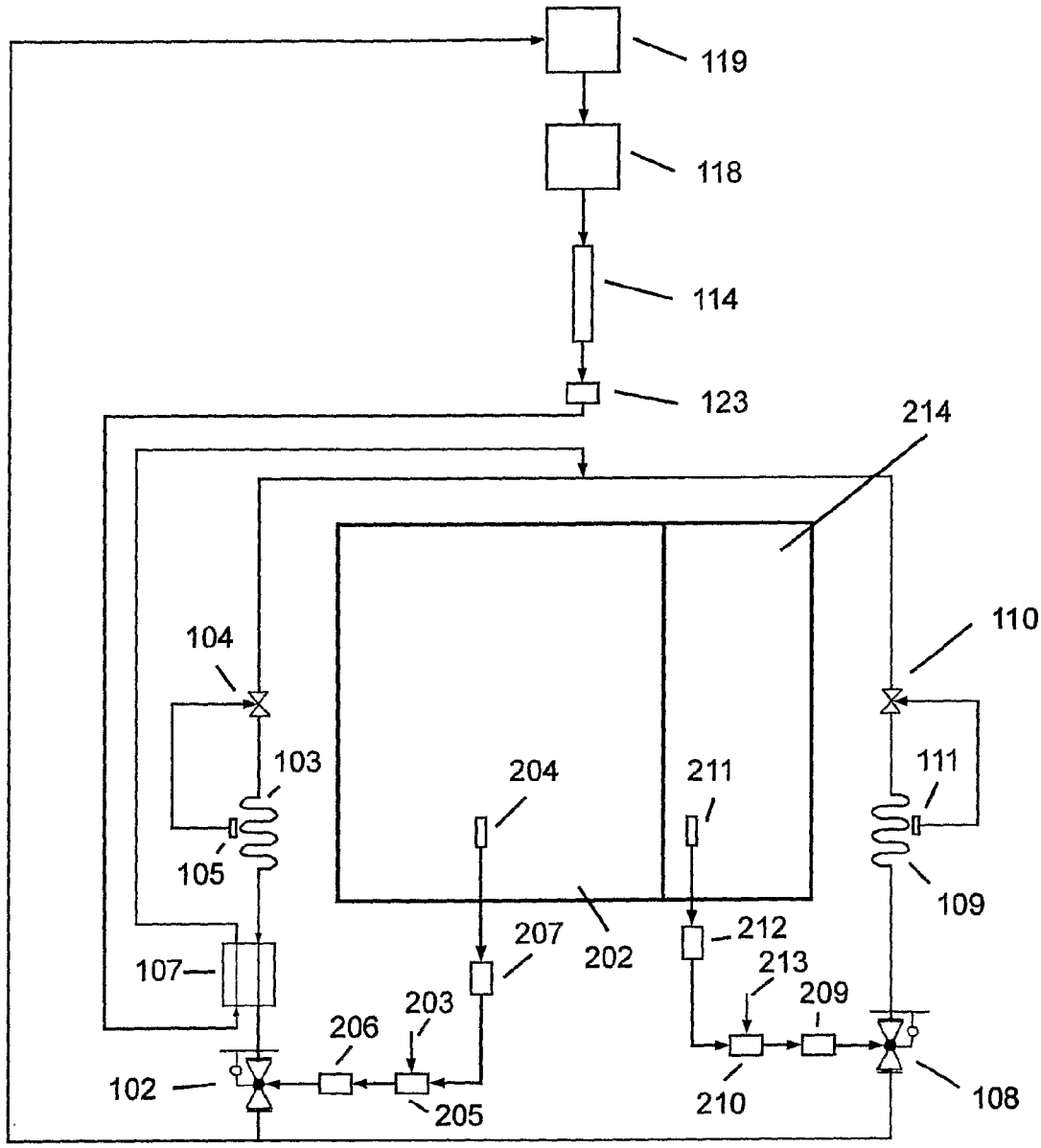
FIG. 2 Shows a line diagram of the apparatus of FIG. 1 with temperature controls.

FIG. 2 shows a line drawing of the exemplary multiple refrigeration compartment of FIG. 1. The temperature in main compartment (compartment 1) 202 can be monitored by a temperature sensor 204, such as a thermistor. Electronic signal conditioning block 207 functions, such as providing a supply voltage and resistor divider to read the resistance of a thermistor, and electronic filtering, can be provided by signal conditioning block 207. Block 205 is representative of a that part of a microcontroller board (entire controller board not shown) that can include at least one analog to digital converter (ADC) to convert an analog signal from signal conditioning block 207 to a digital signal for further processing by the microcontroller board. Function block 205 also includes a an algorithm to receive a desired set point temperature, typically as represented by a value entered into the algorithm and to compare to the digital signal representing the temperature in compartment 1 as measured by temperature sensor 204. Based on factors such as whether the compartment temperature is above or below setpoint, the difference between the desired setpoint temperature 203 (how far the respective compartment temperature is from setpoint) and the feedback temperature as measured by temperature sensor 204 and/or the rate of change of the feedback temperature, a control signal is sent to valve controller 206. In the embodiment of FIG. 1, the suction valve for compartment 1 is shown as ESMV 102 that can advantageously represent a proportional stepper motor controlled valve. The operating position of a preferred proportional stepper motor controlled ESMV 102 can be set by an H-bridge type electronic controller, such as an H-bridge stepper drive pack (used to send an actual ESMV position) as block 206. Control signals can be sent from function block 205 to valve controller 206 in a number of ways including currents, voltages, digital signals, and digital drive patterns. The type and format of such signals is largely determined by the input requirements of valve controller 206. For example, an exemplary ML3 board manufactured by the Carrier Corporation has open collector outputs that can be turned on and off. The ML3 serving as block 205 can thus drive a block 206H-bridge stepper drive pack by creating a stepper motor pattern at the outputs as generated by software algorithms onboard block 205. Generally, if more cooling is required to reduce the temperature in compartment 1, ESMV 102 is commanded by computational block 205 via controller 206 to open further, increasing the refrigerant flow from evaporator 103.

Prior art solutions have added remote refrigeration compartments by cycling on and off the liquid refrigerant supply line to a secondary compartment evaporator to attempt to maintain an evaporator pressure or to maintain a crude temperature regulation in the remote compartments. According to the invention, the temperature in a secondary connected refrigeration compartment (such as a compartment 2 shown in FIG. 2 as compartment 214) is regulated by modulating the return suction pressure of a second compartment evaporator such as evaporator 109. Controls 210 and 209 react to set point temperature 213 and temperature feedback from temperature sensor 211 and signal conditioner 212 to control the position of exemplary ESMV 108 as described for compartment 1. The resulting temperature control in the secondary compartments is far superior to the older method of cycling the high side refrigerant flow on or off.

Computational blocks 205 and 210 include algorithms such as PID control algorithms to modulate (set the position of) ESMV 102 and ESMV 108. When there is adequate cooling capacity as provided by compressor 119 and condenser 118 both PID control loop algorithms modulate the corresponding ESMV to maintain the temperature in each respective compartment as is typically measure using a supply side temperature sensor (such as temperature sensors 204 and 211). However at unit startup and/or during high ambient temperature there might not be enough cooling capacity available for both compartments.

The solution to multiple compartment refrigeration where refrigeration loading exceeds the available refrigeration capacity is to use an algorithm to prioritize refrigeration in one compartment over the other. For example, during startup, most of the cooling capacity can be used to cool a primary compartment that is to be kept below freezing. The freezer compartment ESMV can be modulated to, full open or near fully open, giving maximum refrigerant flow to the corresponding freezer compartment evaporator. During the initial cool down, the ESMV used for the secondary chilled compartment can be modulated to a near closed position. The near closed position can be chosen such that some refrigerant flow is still available at the minimum ESMV modulation position, so some cooling will begin in the secondary compartment. According to one exemplary prioritization, a prioritized primary compartment freezer PID loop will eventually be satisfied when the freezer compartment nears and eventually holds the desired sub zero temperature set point within some preset temperature range. A secondary compartment PID loop is allowed to modulate its ESMV open, perhaps as far as full open, as system cooling capacity becomes available as the primary (higher priority) compartment nears setpoint. With the increased refrigerant flow available to the secondary compartment evaporator, the secondary compartment PID control similarly achieves the desired secondary compartment setpoint temperature within its present allowable temperature range. In the event that some condition, such as an anomalously high ambient temperature, causes the primary freezer compartment to exceed its allowable temperature range, the priority algorithm can limit the maximum setting to the secondary compartment ESMV, thus diverting most or all of the available cooling capacity to the higher priority compartment. In the exemplary description above, it can be seen that it is important to maintain a freezing condition in the higher priority freezer compartment, even at the expense of allowing a wider than normal deviation of the temperature in a secondary refrigeration compartment. In this case, the temporary loss of a precise refrigeration temperature control in the secondary compartment less important than the risk of a thawing condition in the high priority freezer compartment.

According to one embodiment of the invention, a remote delta T can be set in the lower priority compartment. As used herein, remote delta T is the difference between the remote supply air temperature and the remote return air temperature. One way to apportion available cooling capacity between the compartments of a multi-compartment transport refrigeration system, is by setting a delta-T in a remote secondary compartment while allowing a prioritized compartment to make use of the remaining available refrigerant. By setting the remote delta T below that delta T that would otherwise exist with unlimited cooling, the flow of refrigerant to the remote secondary compartment is reduced, but not necessarily limited to an absolute minimum setting. In a remote delta T limiting situation, the remote ESMV is set to a position that allows the temperature difference between the supply and return air to equal the remote delta T setting. This setting allows for some minimal amount of cooling (but, not necessarily an absolute minimum amount) until the host unit reaches a condition where it doesn't require the majority of the capacity available. Ideally, the remote compartment can still maintain its current temperature, or even slowly lower in temperature, depending on the type of cargo in the remote compartment. A remote delta T setting of zero can be used to signal the controller board to shut off the remote unit totally until the host unit is ready to share some refrigerant. Note that a delta T of zero means that no cooling is being done by the remote evaporator because the remote supply air temperature and the remote return air temperature are the same when delta T equals zero.

EXAMPLE 1

Figure 2A:
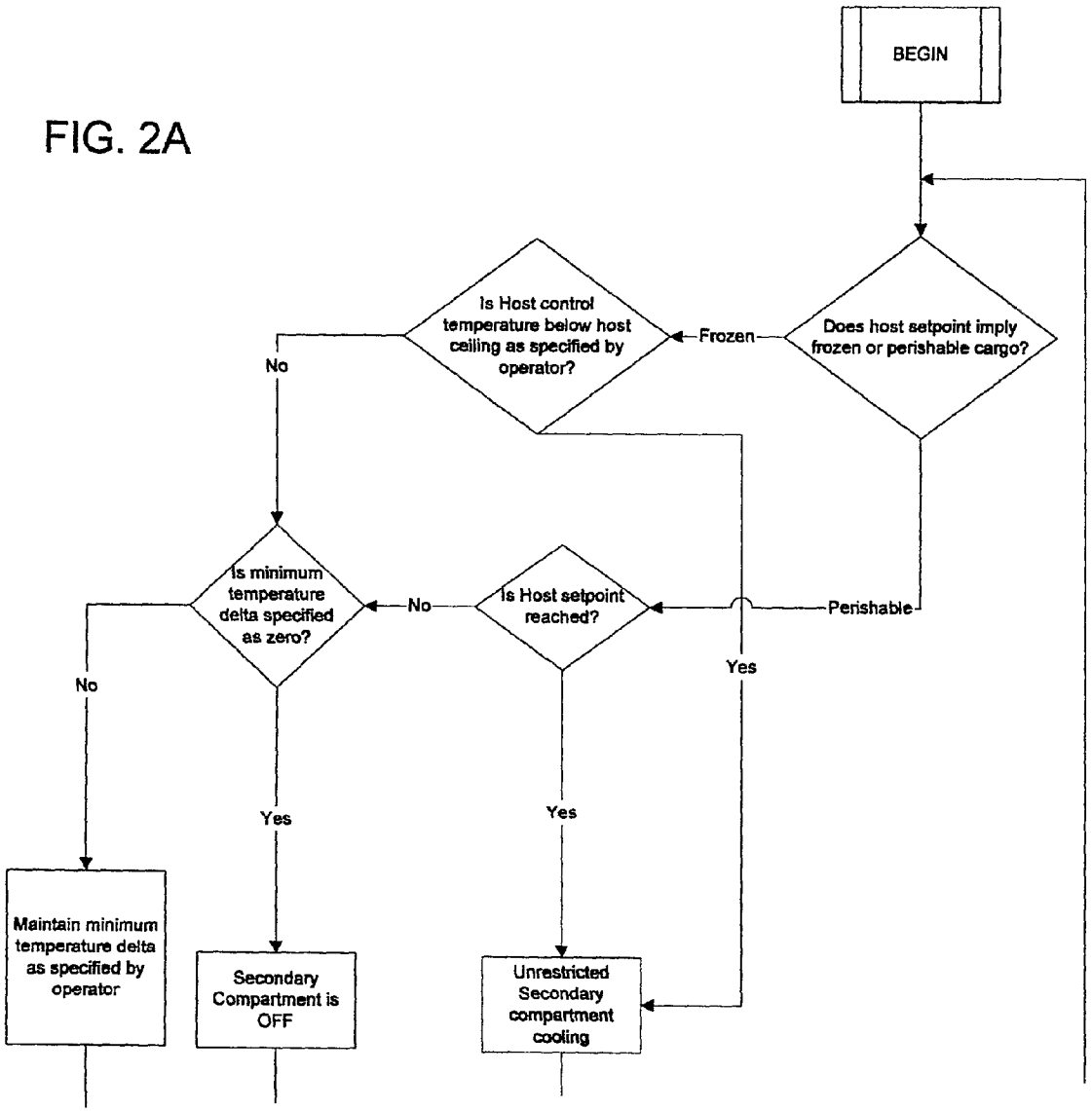
FIG. 2A Shows an exemplary algorithm to prioritize compartments and apportion refrigerant.

The flow chart of FIG. 2A shows an exemplary algorithm to perform the aforementioned prioritization and apportioning of refrigerant during a temporary situation where the transport refrigeration system cooling capacity is insufficient to maintain both compartments at setpoint temperature. Paths of prioritizing actions depend on whether the priority compartment is a freezer compartment or a perishable goods compartment.

In the case of a freezer compartment, prioritizing actions are only required if the freezing temperature reaches a still frozen safety "ceiling". As long as the freezing temperature is below the ceiling, there is no significant deterioration of the frozen goods. This path is shown by the "yes" arrow indicating a freezer compartment temperature below the ceiling that results in a still unrestricted flow of refrigerant to a lower priority secondary compartment. Note that even though in this case the secondary compartment has been deemed of lower priority, there could be a situation where perishable goods in the secondary compartment require a relatively tight temperature tolerance to limit deterioration. In this path, it can be seen that both products have been optimally protected, since the frozen goods remained frozen, albeit not exactly at the desired freezing temperature.

On the other hand, if the temperature in the prioritized freezer compartment is at or above the ceiling temperature, there can be a high risk that those goods might be destroyed by thawing if immediate action is not taken. Following the "No" arrow indicating a ceiling temperature or higher, the algorithm checks the delta T programmed setting for the remote compartment. If it is specified at zero (perhaps indicating an empty secondary compartment), the refrigerant flow to the secondary compartment can be completely turned off until the temperature of the prioritized freezer falls to below the ceiling temperature. Or, if the remote compartment delta T has not been set to zero, a predefined delta T can be used to provide a reduced refrigerant flow to the secondary compartment until the condition is remedied by the prioritized freezer temperature cooling to below the ceiling temperature.

The solution to coping with a finite electrical ampacity in the electrical power supply lines can also be handled by an algorithm to apportion available cooling capacity in light of power demands nearing a preset limit. In an exemplary situation, an ocean going container transport ship might limit the normal AC power load to each container to 23 amperes. Ideally a filled refrigerated compartment is roughly near set point from a precooling device used prior to loading the refrigerated container on the ship. There might be a somewhat higher power load caused by the relatively short time the container was without power, but it is likely that frozen products are still frozen and refrigerated products are still refrigerated below the ambient temperature. The initial cool down could still create a cooling load exceeding the available 23 ampere electrical supply line. More likely, the cooling load could exceed the available supply current during high ambient temperatures, such as a container in full sun with limited outside airflow on the hottest summer days. In such conditions, a multiple compartment refrigerated container according to the invention can cause a limit to be placed on the ESMV in the lower priority compartment. The limit can be to a fully closed modulation position (which still allows a minimal flow of refrigerant) or to some other limit below a full open modulation position. The electrical power limiting algorithm can monitor the load current on the electrical supply line from the container ship and vary the limit on then secondary ESMV to maintain the exemplary limit of 23 amperes. When the condition, such as an anomalous high ambient temperature subsides, the electrical power algorithm detects the lighter load and begins to increase the available maximum secondary compartment ESMV position until there are no restrictions and the secondary compartment PID loop is allowed to use the full available ESMV modulation range from some minimum percentage to some maximum percentage.

EXAMPLE 2

Figure 2B:
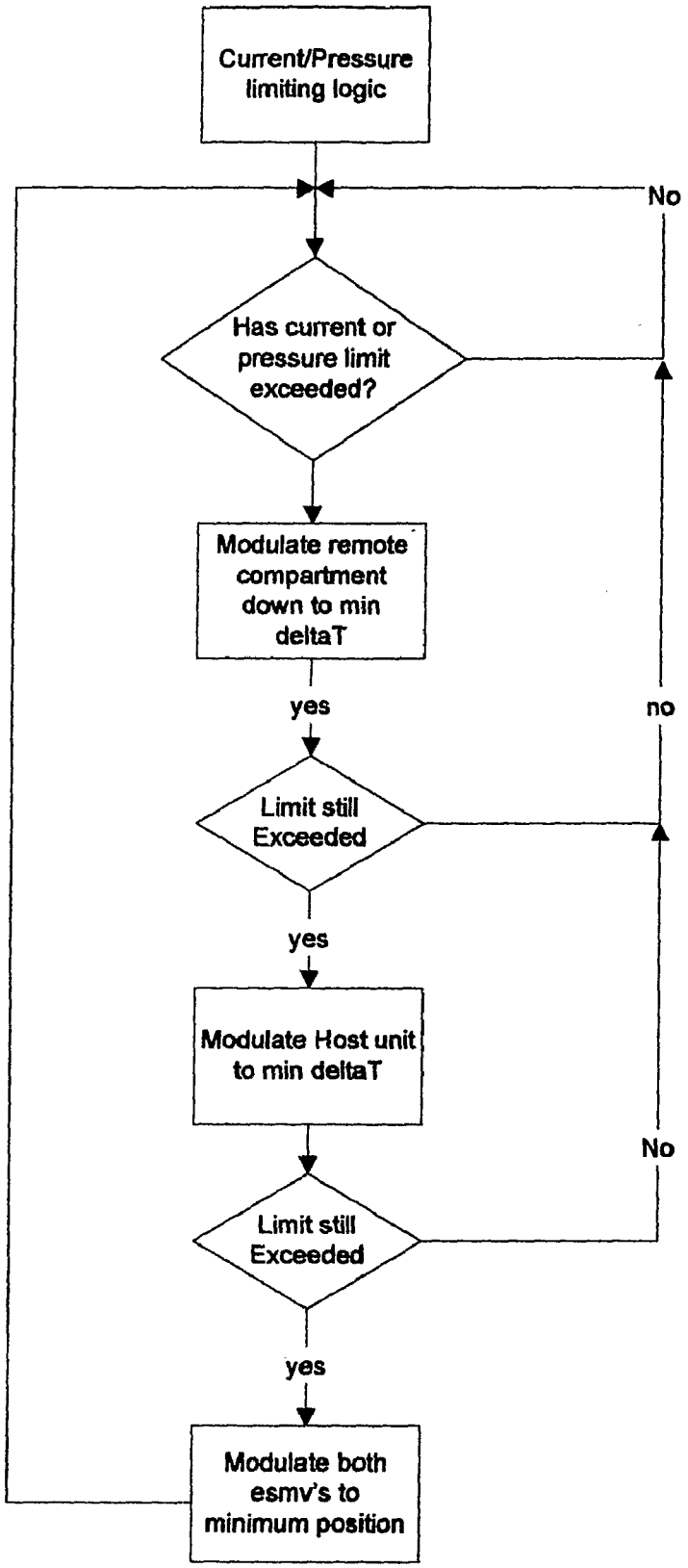
FIG. 2B Shows another exemplary algorithm to prioritize compartments and apportion refrigerant.

The algorithm illustrated by the flow chart of FIG. 2B shows how according to another embodiment of the invention prioritization can be accomplished where the transport refrigeration system electrical load has reached an electrical current limit. Once an electrical current limit is reached, first the remote compartment refrigerant flow is restricted by holding a pre-defined remote compartment delta T (as can be accomplished by modulating the refrigerant flow with an ESMV). If the limit is no longer exceeded, no further action need be taken. Or, if the limit is still exceeded, the prioritized compartment can also be brought to a pre-determined delta T by also restricting the flow of refrigerant to the priority compartment. If the current limit is still exceeded, in a near worst case situation, refrigerant flow can be restricted to an absolute minimum flow (but, not zero flow) to both compartments.

Note that in either the case of insufficient cooling or the case of excessive electrical load current, a minimum delta T, but still above zero, can be pre-programmed into a prioritizing algorithm, or provision can be made on the software or firmware running on a controller board to allow an operator to manually enter a delta T value for the limited cooling compartment and/or the prioritized compartment.

EXAMPLE 3

Figure 3:
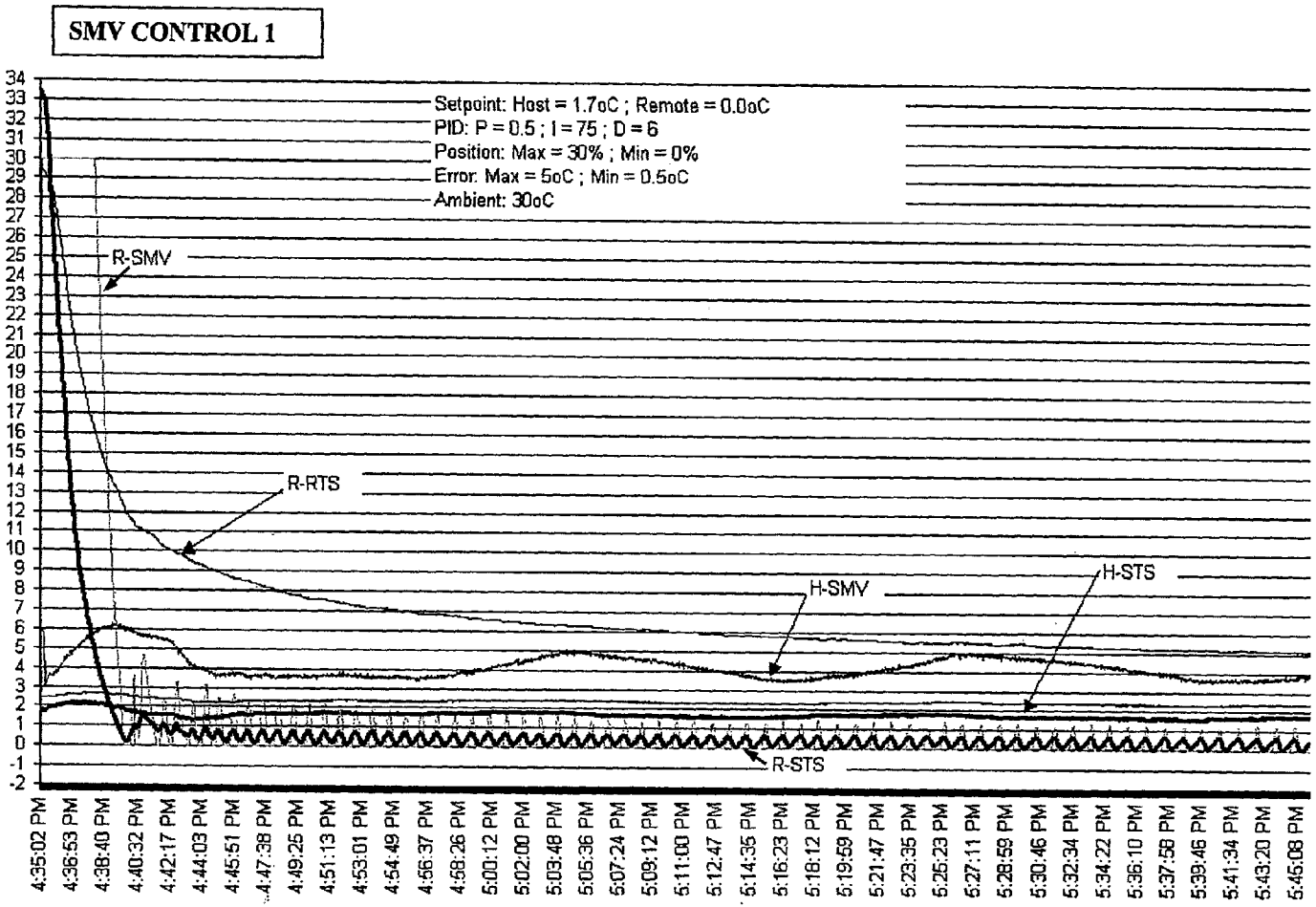
FIG. 3 Shows data comparing prior art on-off refrigerant control to ESMV secondary compartment controls.
Figure 4:
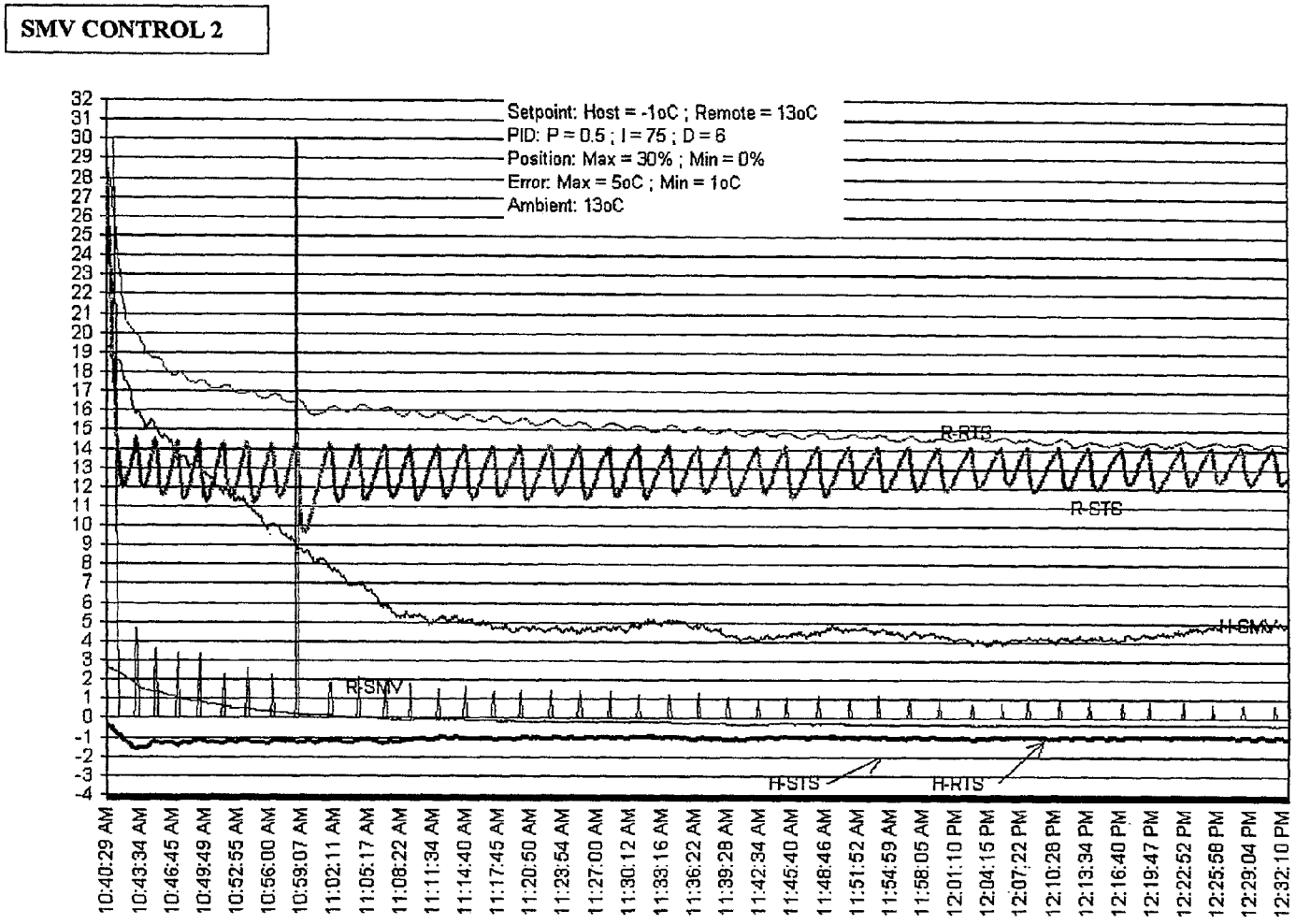
FIG. 4 Shows data comparing prior art on-off refrigerant control to ESMV secondary compartment controls.
Figure 5:
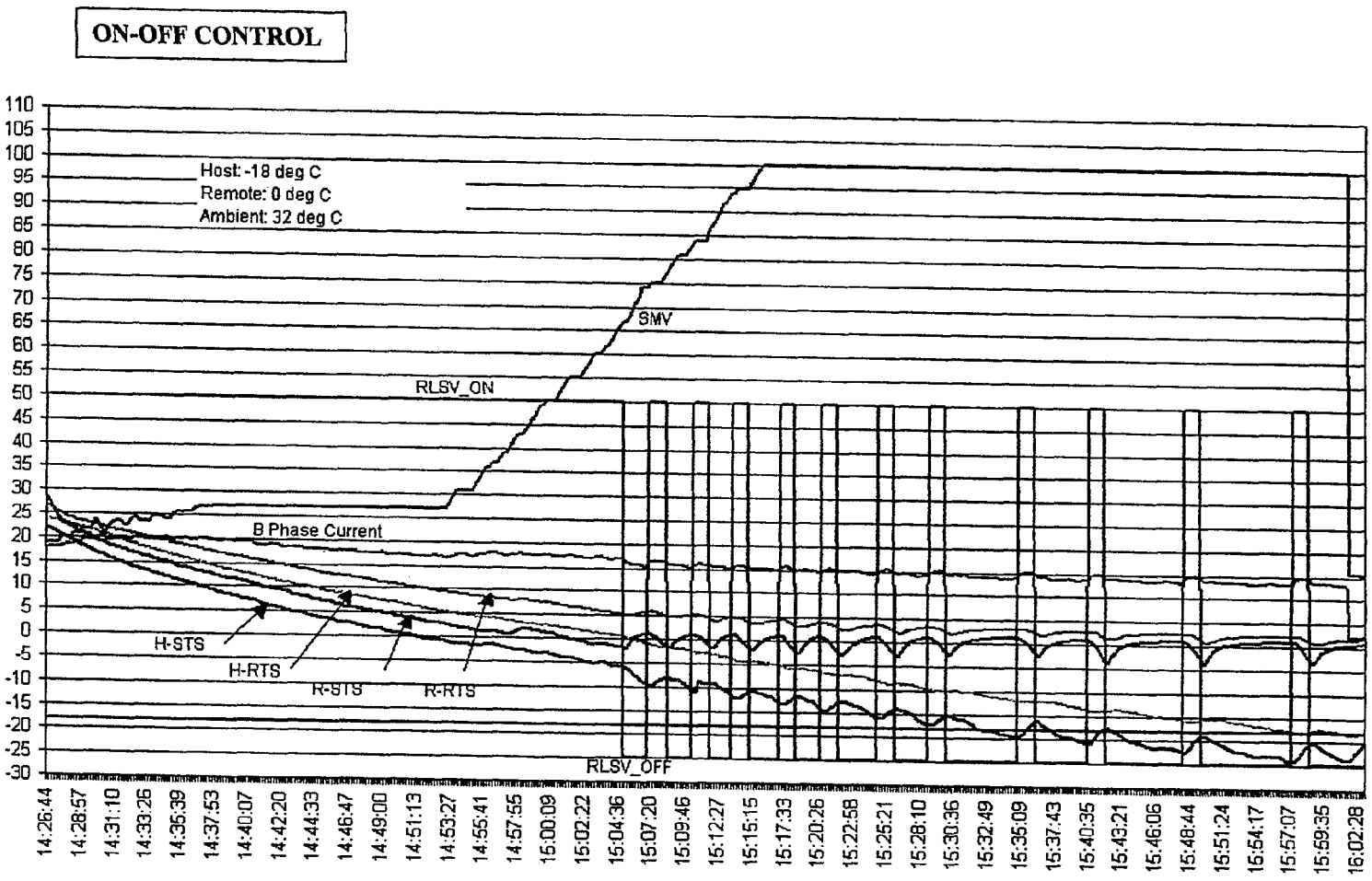
FIG. 5 Shows data comparing prior art on-off refrigerant control to ESMV secondary compartment controls.

A test was conducted to show how modulating the suction pressure from a secondary evaporator compares to prior art technology where secondary compartment temperature control has been achieved by cycling on and off the refrigerant flow to the supply line of the secondary evaporator. FIG. 3 shows data for a test of a two compartment refrigerated transport having a host compartment and a remote compartment. The temperature of the host compartment was set to a setpoint of 1.7° C. and the temperature of the remote compartment was set to a setpoint temperature of 0° C. H-SMV is the modulation position of the host SMV, and R-SMV is modulation position of the remote SMV. SMV position over time is represented on a scale having a fully opened position at the top of the graph and a nearly fully closed position at the bottom of the graph. RTS and STS refer to a return temperature sensor and a supply temperature sensor on the host (H) and the remote (R) evaporators. For example, H-RTS is a curve of the host return temperature sensor reading over time. It can be seen that the host SMV (H-SMV) reached a relatively narrow regulating range in less than 5 minutes and that the host supply side temperature (H-STS) shows temperature regulation to within 1° C. The remote SMV (R-SMV) also reached a rough operating range of regulating positions within about 5 minutes and as can be seen by curve R-STS, the remote compartment temperature also was successfully regulated to within a range of about 1° C. FIG. 4 shows another test with the same refrigerated transport where the host setpoint was −1° C. and the remote temperature setpoint was 13° C. These settings represent the case of freezer compartment and a refrigerator compartment. Again, the host return temperature (H-STS) reached −1° C. and the remote supply temperature reached the desired temperature within about 5 minutes. Within about 25 minutes, the remote supply temperature was within a range of about +/−1° C. Further tuning of PID loops can yield tighter tolerances in the range of the remote compartment supply temperature over time. By contrast, the performance of a two compartment refrigerated transport operated according to the prior art with suction control for regulating the temperature of the host compartment and on/off refrigerant cycling control to regulate the temperature of a remote compartment is shown in FIG. 5. Here, it can be seen that as the refrigerant line is cycled on and off (RLSV_ON and RLSV_OFF), the remote supply temperature (R-RTS) varies by more than +/−5° C. A +/−5° C. temperature regulation range is unacceptable for many types of perishable produce stored in a remote compartment over days or weeks such as when shipped in a multi-compartment refrigerated container on a container ship.

EXAMPLE 4

Figure 6:
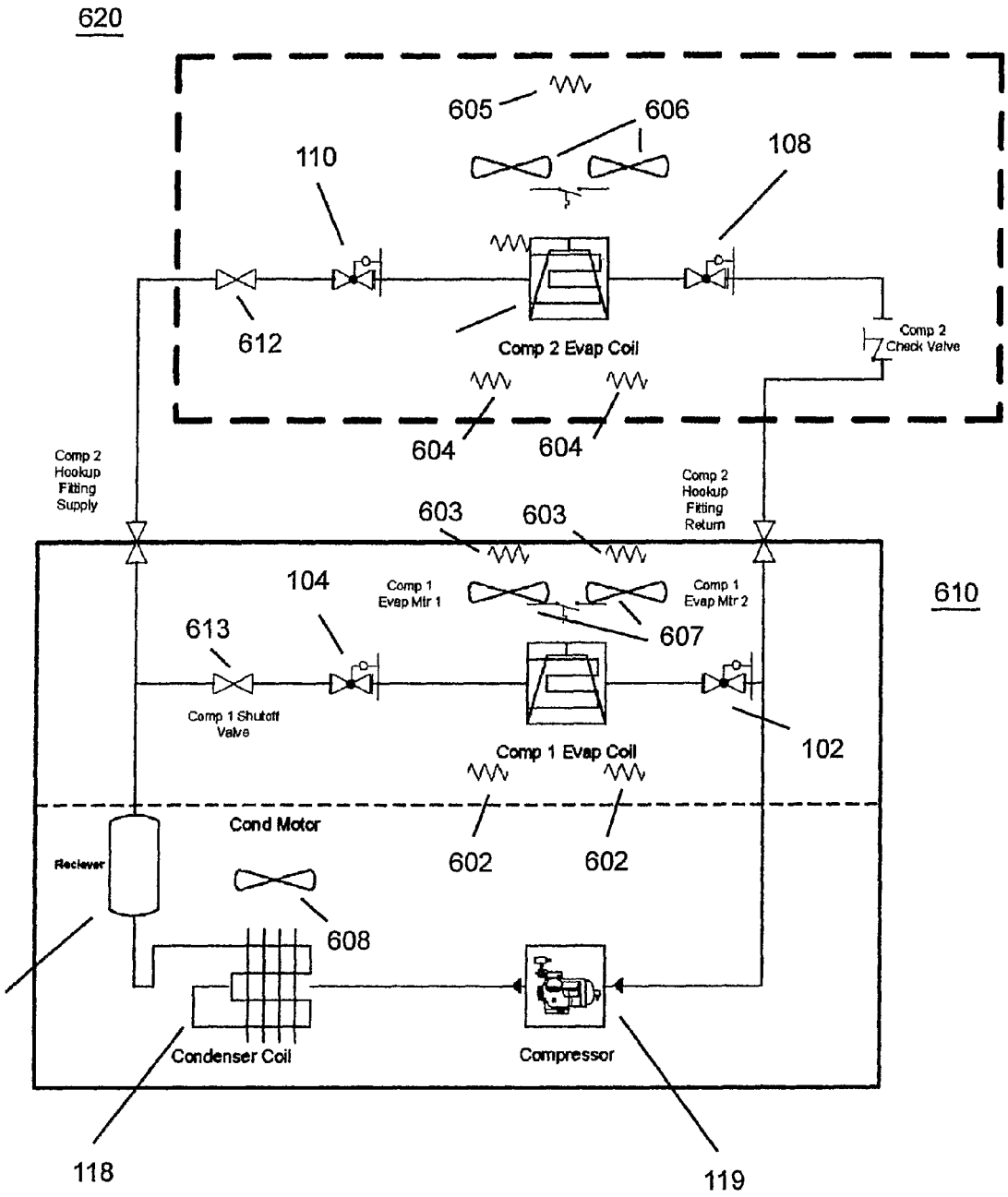
FIG. 6 Shows a refrigeration diagram of an exemplary two compartment refrigerated transport.
Figure 7:
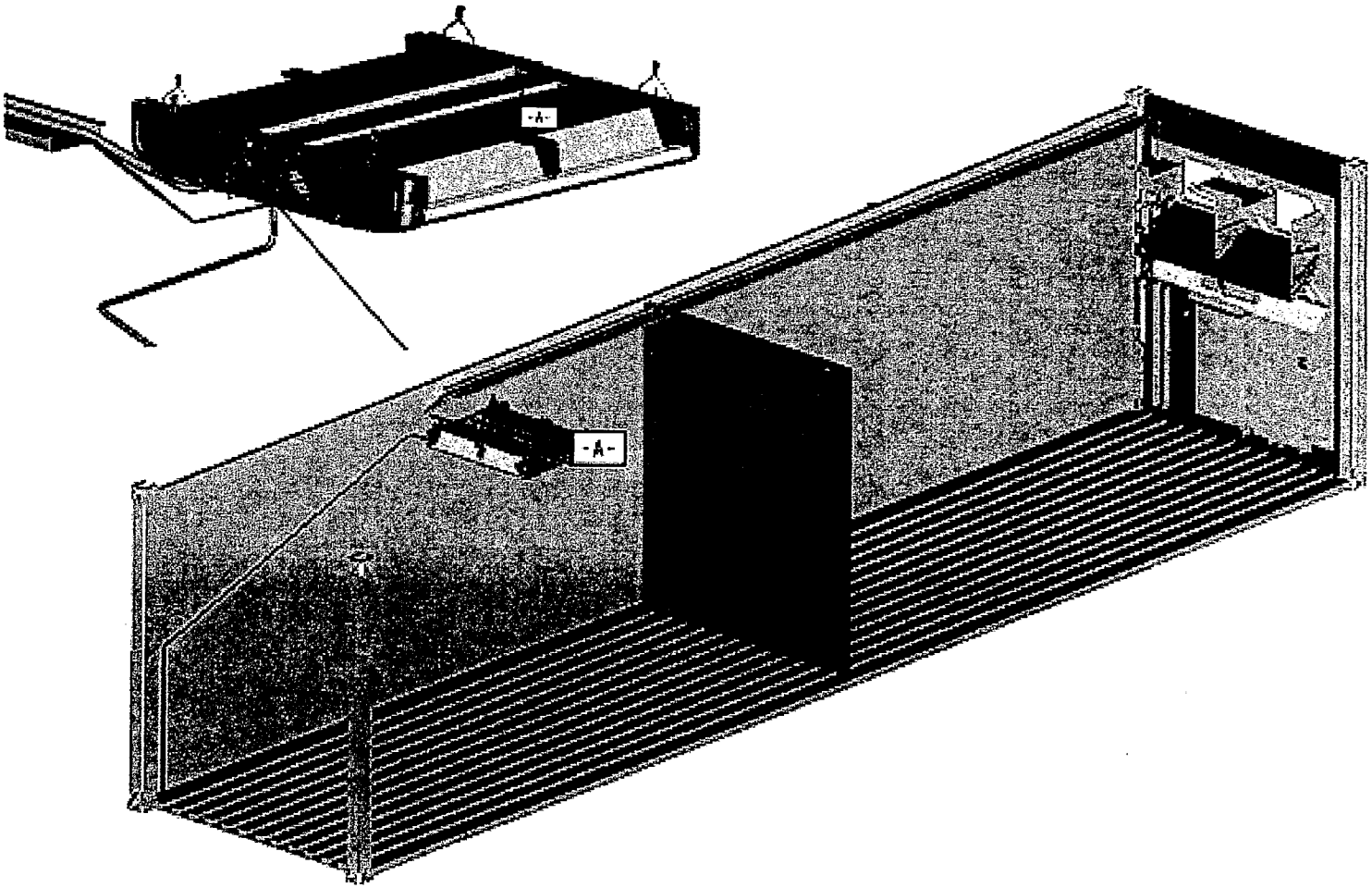
FIG. 7 Shows one embodiment of a dual compartment refrigeration container.

A two compartment refrigerated container was built using the inventive dual suction temperature control method. FIG. 6 shows a refrigeration diagram representative of the dual compartment container. A HAR container unit 610 manufactured by the Carrier Corporation under the trade name "Transicold" provides the host compartment cooling. A Carrier Transicold MVD 1100 Vector remote evaporator unit 620 was modified for use with a remote electronic suction valve 108 14-00263 manufactured by the Sporlan Corporation, A 134A (0689U2821) TXV 104 and 110 manufactured by the Danfoss Corporation was used for the remote expansion valve. A Sporlan liquid line shutoff valve 612 and 613 was used in both the host and remote evaporator refrigerant lines. A modified Capitol receiver 114 was used for refrigerant storage. Fans 606 and 607 provide evaporator air flow. Fan 608 draws air thru the condenser coil 118. Supply side thermistor temperature sensors 602 and 604 and return system thermistor temperature sensors 603 and 605 are 10 kilo ohm thermistor manufactured by the Fenwall Corporation, such as model numbers 590-59EJ04-103 or 590-59EL06-103. Typically only one of the supply side thermistors 602 or 604 is used as the compartment temperature sensor 204 or 211 as the temperature feedback signal for each suction pressure control PID loop. System performance was found to be consistent with the test results presented in Example 1. FIG. 7 shows the assembled dual compartment refrigeration container. The remote evaporator is shown by the assembly marked "A" and the host refrigeration system, including the common compressor and condenser is shown located in the right side wall of the container.

It should be noted that while the invention has been illustrated by embodiments having two compartments, that additional secondary compartments (including remote compartments) can be added using additional suction valves such as additional ESMVs.

While ESMV Other suction valves have been used in a preferred embodiment of the invention, other types of suction valves can be suitable for use in place of the ESMV units.

Sensors 204 and 211 have been described as thermistors using signal conditioning 207 and 212 as circuitry to convert a temperature sensitive resistance to a proportional voltage representing that resistance that can be digitized and correlated to a temperature. The circuitry has also been described as including filtering such as by RC filtering. A sensor such as a thermistor is preferred at least in part because it has a relatively large change in value over the typical temperature ranges encountered in refrigerated compartments. It should be noted however, that any type of sensor that can create a signal proportional to a measured temperature might be suitable for use in this application. Also, there is no specific requirement for signal conditioning blocks 207 and 212 (that can be located inside or outside of the compartment). For example, one modern sensor trend is towards smart sensors that include all needed signal conditioning in one package. Such a smart sensor might also eliminate the need for an ADC on controller blocks 205 and 210. Conversely, the invention could be implemented solely in analog electronics using all analog signals and linear negative feedback loops. There could be one conversion to digital signals to control the types of ESMV units heretofore described, or there could be other types of suction valves that can analog input signals to position the suction valve.

In a preferred embodiment, controllers 205 and 210 are part of a microcontroller board. Analog sensor signals can be converted to digital sensor signals off or on controller boards 205 and 210. Algorithms can include control loop techniques such as conventional proportional-integral-derivative (PID) or proportional-integral (PI) loops to control the suction valves based on temperature sensor 204 and 211 temperature measurements. Other feedback and control strategies including less traditional control loop approaches can be used as well as long as there is a suction valve in the refrigerant return line of an evaporator serving a remote compartment and it responsive to a temperature measurement made in the remote compartment.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A refrigerated transport system comprising:

a compressor to supply high pressure refrigerant vapor to a condenser, the compressor coupled to the condenser, the condenser to condense the high pressure vapor to a high pressure liquid;

a primary compartment evaporator to accept heat from the air in a primary compartment and to transfer the heat to a refrigerant circulated within the primary compartment evaporator to refrigerate the primary compartment, the primary compartment evaporator coupled to a primary compartment expansion device for receiving low pressure liquid from the primary compartment expansion device, the primary compartment expansion device coupled to the condenser, and a primary refrigerant flow through the primary compartment evaporator is controlled by a controller using a primary compartment temperature feedback from a temperature sensor in the primary compartment to control the temperature in the primary compartment; and at least one secondary compartment evaporator to accept heat from the air in a secondary compartment and to transfer the heat to a refrigerant circulated within the secondary compartment evaporator to refrigerate the secondary compartment, the secondary compartment evaporator coupled to a secondary compartment expansion device for receiving low pressure liquid from the secondary compartment expansion device, the secondary compartment expansion device coupled to the condenser, and a secondary refrigerant flow through the secondary compartment evaporator is controlled by a controller using a secondary compartment temperature feedback from a temperature sensor in the secondary compartment to control the temperature in the secondary compartment and wherein a prioritizing algorithm limits the maximum amount of refrigerant flow available to at least one limited cooling compartment by holding a delta T (difference between the supply air temperature and return air temperature) instead of a setpoint temperature in the at least one limited cooling compartment when the available cooling capacity is insufficient to hold a substantially constant temperature in all compartments.

2. The system of claim 1 wherein the available cooling capacity is limited by the cooling capacity of the compressor and condenser for a given refrigeration load, or where the compressor and the condenser have a sufficient cooling capacity, but the compressor and the condenser are prevented from operating at the sufficient cooling capacity because of a limit imposed on an electrical power supply to power the refrigerated transport system and the delta T of the at the at least one limited compartment is held to a minimum delta T.

3. The system of claim 1 wherein the available cooling capacity is limited by the cooling capacity of the compressor and condenser for a given refrigeration load, or where the compressor and the condenser have a sufficient cooling capacity, but the compressor and the condenser are prevented from operating at the sufficient cooling capacity because of a limit imposed on an electrical power supply to power the refrigerated transport system and the delta T of the at the at least one limited compartment is held to a delta T selectable by an operator.

4. The system of claim 1 wherein the primary or secondary evaporator refrigerant flow is controlled by an electronic suction modulation valve (ESMV).

5. The system of claim 4 wherein the primary or secondary ESMV is controlled by an electronic H-bridge controller.

6. The system of claim 5 wherein the electronic H-bridge controller is an H-bridge stepper drive pack.

7. The system of claim 6 wherein the H-bridge stepper drive pack is controlled by a software generated stepper motor pattern.

8. The system of claim 7 wherein the software generated stepper motor pattern drives the H-bridge stepper drive pack to command the ESMV to a position responsive to a compartment temperature feedback signal to control the temperature in the compartment.

9. The system of claim 1 wherein the primary or secondary compartment temperature sensor is a thermistor.

10. The system of claim 1 wherein the temperature (in both the primary and the secondary refrigerated compartments) is regulated to a tolerance of at least plus or minus one kelvin except when there is a cooling limit imposed on one or more secondary compartments.

11. The system of claim 1 wherein the primary refrigerated compartment and the secondary refrigerated compartment are housed within a container selected from the group of transport containers consisting of an aircraft shipping container, an ocean shipping container, a tractor trailer truck, and a railroad car.

12. The system of claim 1 wherein the expansion device is a thermal expansion valve (TXV).

13. The system of claim 12 further comprising a heat exchanger to exchange heat between an evaporator return line and a liquid refrigerant line to reduce the temperature drop across the TXV to improve the efficiency of the TXV.

14. The system of claim 13 comprising two or more heat exchangers to further increase system capacity.

15. A method for creating multiple refrigerated compartment spaces having precision temperature control comprising the steps of:providing a common compressor to supply high pressure refrigerant vapor;

providing a common condenser to condense the high pressure refrigerant vapor to a high pressure liquid;

providing a primary compartment evaporator to accept heat from the air in a primary compartment and to transfer the heat to a refrigerant;

providing a secondary compartment evaporator to accept heat from the air in a secondary compartment and to transfer the heat to a refrigerant;

compressing the refrigerant;

condensing the refrigerant;

supplying the refrigerant via expansion devices to the primary compartment evaporator and the secondary compartment evaporator;

regulating the refrigerant flow to the primary compartment evaporator and the secondary compartment evaporator to control the temperature in both compartments to respective setpoint temperatures using temperature feedback signals from each respective compartment;

prioritizing the compartments by identifying at least one priority compartment to be held at a setpoint temperature and at least one nonpriority compartment; and limiting the maximum amount of refrigerant flow available to the at least one nonpriority compartment by holding a difference between the supply air temperature and the return air temperature in the at least one nonpriority compartment when there is insufficient cooling capacity to maintain all compartments at their respective setpoint temperatures.

16. The method of claim 15 wherein limiting the maximum amount of refrigerant flow available to at least one nonpriority compartment by holding a difference between the supply air temperature and the return air temperature in the at least one nonpriority compartment comprises the method step of limiting refrigerant flow to all but the priority compartment when there is insufficient cooling capacity to maintain all compartments at their respective setpoint temperatures because the compressor and the condenser have an insufficient cooling capacity for a given refrigeration load or, the compressor and the condenser have a sufficient cooling capacity, but the compressor and the condenser are prevented from operating at the sufficient cooling capacity because of a limit imposed on an electrical power supply to power the refrigerated transport system.

17. The method of claim 15 wherein regulating the refrigerant flow comprises the method step of regulating the refrigerant flow to the primary compartment evaporator and the secondary compartment evaporator using electronic suction modulation valves to control the temperature in both compartments using temperature feedback signals from each respective compartment.

18. The method of claim 15 wherein supplying the refrigerant via expansion devices comprises the method step of supplying the refrigerant via thermal expansion valves to the primary compartment evaporator and the secondary compartment evaporator.

19. The method of claim 15 wherein supplying the refrigerant via expansion devices comprises the method step of supplying the refrigerant via thermal expansion valves to the primary compartment evaporator and the secondary compartment evaporator.

20. The method of claim 19 further comprising the method step of coupling heat between an evaporator return refrigerant line and a liquid refrigerant supply line using one or more heat exchangers to improve the efficiency of the thermal expansion valves by reducing the temperature across the valves.

21. The method of claim 15 wherein prioritizing the compartments comprises the method step of prioritizing the compartments by identifying at least one priority compartment to be held at a setpoint temperature to at least within plus or minus one kelvin of the setpoint temperature.

* * * * *